US011414250B2

(12) United States Patent
Veit et al.

(10) Patent No.: US 11,414,250 B2
(45) Date of Patent: Aug. 16, 2022

(54) STAND-UP PACKAGING

(71) Applicant: SOCIETE DES PRODUITS NESTLE S.A., Vevey (CH)

(72) Inventors: Benjamin Veit, Singen (DE); Michael Ellenrieder, Steisslingen (DE)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 16/603,311

(22) PCT Filed: Apr. 4, 2018

(86) PCT No.: PCT/EP2018/058568

§ 371 (c)(1),
(2) Date: Oct. 7, 2019

(87) PCT Pub. No.: WO2018/189004

PCT Pub. Date: Oct. 18, 2018

(65) Prior Publication Data

US 2021/0107717 A1 Apr. 15, 2021

(30) Foreign Application Priority Data

Apr. 11, 2017 (EP) ..... 17166025

(51) Int. Cl.

| | |
|---|---|
| ***B65D 33/04*** | (2006.01) |
| ***B65D 75/52*** | (2006.01) |
| ***B65D 33/00*** | (2006.01) |
| ***B65D 33/16*** | (2006.01) |
| ***B65D 75/00*** | (2006.01) |

(52) U.S. Cl.
CPC ..... *B65D 75/525* (2013.01); *B65D 33/007* (2013.01); *B65D 33/1691* (2013.01); *B65D 75/008* (2013.01); *B65D 2207/00* (2013.01)

(58) Field of Classification Search
CPC .. B65D 75/525; B65D 75/008; B65D 33/007; B65D 33/1691; B65D 2207/00
USPC ..... 383/119
See application file for complete search history.

(56) References Cited

U.S. PATENT DOCUMENTS

| | | | | |
|---|---|---|---|---|
| 2,850,160 A | | 9/1958 | Siebel et al. | |
| 3,144,129 A | * | 8/1964 | Weisberg | B65D 33/02 206/45.24 |
| 3,189,253 A | * | 6/1965 | Mojonnier | B65D 33/007 383/204 |

(Continued)

FOREIGN PATENT DOCUMENTS

| | | |
|---|---|---|
| BE | 1013260 A6 | 11/2001 |
| CL | 2010000546 A1 | 8/2010 |

(Continued)

*Primary Examiner* — Peter N Helvey
(74) *Attorney, Agent, or Firm* — K&L Gates LLP

(57) ABSTRACT

The present invention relates to a stand-up packaging (1) for food products comprising at least one pouch (2) for carrying a food product, an outer packaging (3) having two cover elements (31,32) at least partially sandwiching the pouch (2), and at least one further element (33,2') being at least partially sandwiched between the pouch (2) and one of the cover elements (31). The further element (33,2') is penetrated by a through hole (22,36). The one cover element (31) is glued (G) to the pouch (2) via the through hole (22,36).

14 Claims, 5 Drawing Sheets

(56) References Cited

U.S. PATENT DOCUMENTS 3,305,159 A * 2/1967 Becker ..... B65D 75/30 229/221
3,326,364 A * 6/1967 Waldrop ..... B65D 5/542 206/466
3,339,721 A 9/1967 Goldstein
3,339,820 A * 9/1967 Krzyzanowski ... B65D 5/46096 229/216
3,392,901 A * 7/1968 Krzyzanowski ..... B65D 77/062 229/117.32
3,407,928 A 10/1968 Watts
3,482,758 A * 12/1969 La Pierre ..... B65D 5/603 229/117.27
3,521,807 A * 7/1970 Weisberg ..... B65D 77/064 229/117.27
3,684,156 A * 8/1972 Fettinger ..... B65D 75/525 229/240
4,979,611 A * 12/1990 Bolliger ..... A61C 7/12 206/0.84
5,295,630 A * 3/1994 Parish ..... B65D 5/42 229/106
6,076,968 A 6/2000 Smith et al.
D450,577 S * 11/2001 Nielsen ..... D9/705
6,962,439 B2 * 11/2005 Taheri ..... B65D 33/004 383/204
7,931,147 B2 * 4/2011 Petrelli ..... B65D 73/0092 206/464
8,070,359 B2 * 12/2011 Taheri ..... B29C 48/832 383/66
8,875,872 B2 * 11/2014 Bulls, Jr. ..... B65D 73/0078 206/45.24
10,703,550 B2 * 7/2020 Onesti ..... B65D 75/525
2005/0051459 A1 3/2005 Casanova
2005/0139508 A1 6/2005 Su
2013/0114918 A1 5/2013 Lyzenga et al.
2013/0330446 A1 12/2013 Onogi et al.
2016/0023835 A1 1/2016 El-Afandi et al.
2016/0250817 A1 9/2016 Fransson et al.

FOREIGN PATENT DOCUMENTS

CN 201395300 Y 2/2010
CN 201914547 U 8/2011
CN 103010634 A 4/2013
DE 20009022 10/2000
GB 759886 10/1956
GB 855449 11/1960
KR 20170005566 A 1/2017
WO 9708070 3/1997
WO 2007023647 A1 3/2007
WO 2007090415 A1 8/2007

* cited by examiner 1
3
32
34
35
31
33

1
3
20
32
2
2'
2'
37
31

1
20
3
32
35
2
2'
2'
37
31
33

1
2
2'
20
22
24
31
32
33
33'
34
36
37
G
N

STAND-UP PACKAGING

CROSS REFERENCE TO RELATED APPLICATIONS

The present application is a National Stage of International Application No. PCT/EP2018/058568, filed on Apr. 4, 2018, which claims priority to European Patent Application No. 17166025.1, filed on Apr. 11, 2017, the entire contents of which are being incorporated herein by reference.

The present invention relates to a stand-up packaging or package for food products having a pouch for carrying a food product and an outer packaging at least partially surrounding the pouch.

Such stand-up packagings are well-known in the prior art. To fix the sleeve or pouch to the outer packaging, present packagings use stapler or other mechanical fixing means or ultrasonic sealing, heat sealing or sewing. These techniques either require costly apparatuses and manufacturing processes and/or use additional fixing means like stapler which might end up in the food stored within the sleeve or pouch (foreign body). In addition the outer packaging cannot be separated from the pouch without destroying the pouch.

It is thus an object of the present invention to provide a stand-up packaging for food products as initially described in a simple, cost efficient manner and a consumer friendly way to dismantle the packaging.

The object is to be accomplished by means of the independent claim. The dependent claims advantageously study further the central idea of the present invention.

According to an aspect of the present invention, there is provided a stand-up packaging for food products. The stand-up packaging comprises at least one pouch for carrying a food product. The stand-up packaging further comprises an outer packaging having two (i.e. a first and a second) cover elements at least partially sandwiching the pouch. The stand-up packaging further comprises at least one further element being at least partially sandwiched between the pouch and one of the two mentioned cover elements (in the following also referred to as "the one cover element"). The further element is penetrated by a through hole. The one cover element is glued to (i.e. directly glued to) the at least one pouch via (i.e. through) the through hole. Hence, the glue which extends through the through hole of the further element can act as a kind of plug or bolt being fixedly attached or connected (i.e. directly glued) to the opposite elements (i.e. the one cover element and the at least one pouch) to thus carry the pouch(es) via the outer packaging. If more than one pouch is present, all of these pouches can be connected/glued to the outer packaging (i.e. the one cover element) via at least one or a plurality of through holes of at least one or a plurality of further elements.

According to the present invention, the term "stand-up packaging" covers any kind of packages, which are by themselves and in particular by their design able to stand alone when being placed on a preferably flat ground e.g. doypack, gusseted bottom bag and flow wrap, preferably a doypack.

According to the present invention, the term "food products" covers any kind of consumable products, particularly any kind of consumable products which are generally carried and sold in such stand-up packages. The food products can have any consistency and may, for instance, be fluid, flowable, pasty, jellylike, powdered, solid and the like.

According to the present invention, the term "pouch" can be any kind of preferably deformable or flexible packaging for carrying a food product; i.e. it is made of a food safe material. In particular, it can be made of a sealable material to thus provide a closed and preferably hermetically sealed (e.g. air-tight) pocket for receiving the food product.

According to the present invention, the term "outer packaging" covers all kind of packagings to carry and/or enclose pouches as described herein above. The outer packaging is preferably made of cardboard or plastics. It is preferably imprinted to carry information with respect to the content (e.g. food product; meal) of the stand-up packaging, like pictures, texts (cooking recipe; ingredients; nutrition facts; etc.), barcodes and the like.

According to the present invention, any kind of "glue" can be used which allows a direct gluing connection between the respective elements (i.e. cover element and pouch) to be connected via (i.e. through) the through hole.

According to the present invention, "glued [ . . . ] via the through hole" is to be understood as "glued [ . . . ] through the through hole", i.e. that the glue extents through the through hole to thus directly connect the elements being positioned opposite with respect to the through hole.

According to the present invention, "glued to each other" is to be understood as being "directly glued to each other", i.e. that the glued elements are directly glued and thus connected to one another by means of glue irrespective of the glue extending between these elements via (i.e. though) the through hole.

With respect to the present invention, it is possible to easily provide fixing means (by simple use of glue) to the outer packaging—and in particular to one of its cover elements—and at the same time connect the outer packaging with the pouch(es) to thus obtain a ready stand-up packaging carrying the pouch(es) and without the use of additional fixing means; i.e. in an easy and cost efficient manner. This comes about since glue can be easily provided from one outer side of the stand-up packaging and easily reaches the elements intended to be glued to each other as the glue is applied in a region of the through holes; as glue extends through the respective through holes, it may function as a kind of plug or bolt carrying and fixing the further elements and allowing the at least one pouch to be securely attached to the outer packaging.

The further element can be a third cover element of the outer packaging. Alternatively or additionally, the further element can comprise at least one or a plurality of additional pouches for carrying a food product. The additional pouches are generally similar to the at least one pouch. The different pouches—i.e. the at least one pouch as well as the additional pouches—may carry different ingredients of a particular recipe/meal. Both, the third cover element and the additional pouch(es) comprise the through hole(s) as described herein above. They are thus at least partially sandwiched between the at least one pouch and the one cover element such that the one cover element is glued to the at least one pouch via the through hole(s) of these further elements.

In a preferred embodiment, the stand-up packaging may comprise a plurality of further elements, like the third element and/or the additional pouches for carrying a food product, respectively. The one cover element is then glued to the at least one pouch via at least one and preferably via each of the through holes of the further elements. The one cover element may preferably also be glued to at least one of the further elements via the respective through holes. It is thus possible to connect the one cover element to the at least one pouch by being glued to each other via at least one of the through holes. Dependent on the arrangement of the further elements and in particular of the corresponding through holes, the one cover element and the at least one pouch are glued to each other via at least one, a plurality or all of the through holes. In the latter case, the through holes of at least two and preferably of all of the further elements can be aligned to one another so that the glue extends through all of the through holes to connect the one cover element to the at least one pouch. It is, however, also possible that the additional pouches are arranged such that they or their through holes are off set with respect to each other such that at least one of the through holes allows the one cover element to be directly glued to the at least one pouch via said through hole. The other through holes might be arranged in a similar way and may thus also allow direct connection of the one cover element to the at least one pouch by glue extending through the respective through holes. They may thus allow at least one of the two cover elements to be glued to the at least one pouch or—alternatively—to one of the additional pouches via at least one of these other through holes.

At least one and preferably all of the pouches (including the at least one pouch as well as the additional pouch(es)) may comprise a sealing region. This sealing region is provided to close at least part of the pouch to securely carry the food product within the pouch. In a preferred embodiment, it is the sealing region of at least one of the additional pouches which is penetrated with the through hole preferably in an upper portion of said pouch or its sealing region. In a most preferred embodiment, the sealing region circumferentially surrounds the respective pouch to form a pocket of said pouch to carry the food product; preferably in a (hermetically) sealed manner. If the sealing region is penetrated with the through hole, the pocket is not affected by the through holes and—if hermetically sealed—remains sealed irrespective of the through holes penetrating the additional pouch.

At least one of the through holes and preferably all of the through holes comprise(s) at least two or more distant through holes. In fact, the number of distant through holes per further element (i.e. per additional pouch or third cover element) is not limited by the present invention. However, at least two distant through holes are preferred to allow for a secure fixation of the pouch at at least two points thus reducing the effect of torque acting upon the glued fixing regions. In a preferred embodiment, the distant through holes of at least two and preferably all of the through holes are aligned to each other, respectively. This allows for an easy connection of the pouches to the outer packaging and in particular a connection of the one cover element to the at least one pouch via the through holes of the further element(s) preferably being aligned with one another. Through holes of the pouches and the sleeve can be taken as a centering element during production.

In general, at least two and preferably all of the through holes—i.e. the through holes of at least two and preferably of all of the further elements—can be aligned to each other. This only requires a small amount of glue for securely fixing the pouches and closing the outer packaging to obtain a completed stand-up packaging.

According to the present invention, the shape of the through hole(s) is not limited. However, the through hole and preferably each of the distant through holes can have a rounded or polygonal shape, like a circular, oval or square shape. These kinds of shapes can be easily manufactured.

At least one of the (e.g. first and second) cover elements may directly be glued to at least one of the (neighboring) further elements (e.g. additional pouch(es) and/or third cover element). This can preferably be obtained via at least one of the through holes. In other words, glue can also be provided in a region other than regions being aligned with (some of) the through holes to also allow for a secure fixation of a corresponding cover element with the corresponding (neighboring) element preferably having a through hole (e.g. the neighboring additional pouch or third cover element).

The glue being used for the stand-up packaging can be provided as glue dots or a line of glue at least partially covering the through holes. "At least partially covering" means that the glue must at least partially extend over the corresponding through holes to allow the one cover element being glued to the at least one pouch via said through holes. The glue, however, can also cover regions surrounding or between the through holes to allow for neighbouring elements to be glued to each other directly to thus provide a firm connection of these elements of the outer packaging and/or the outer packaging and the corresponding (additional) pouches.

At least one of the cover elements—preferably the one cover element—can have a gluing region and a flap region being divided by a weakened tear-opening region. The tear-opening region is preferably configured (in any desired manner) to allow for separation of the gluing region and the flap region so that the flap region is released to allow access to the pouches, e.g., by bending open the flap region. The weakened tear-opening region can thus be provided as weakened (e.g. thinned) material region in the respective cover element. The weakened tear-opening region can also be configured to be removable to thus release the flap region to access the pouches in the outer packaging. Hence, a simple opening means can be integrally provided with the stand-up packaging.

The outer packaging may further comprise a preferably flat base element for supporting or even carrying the stand-up packaging if being placed on the ground. The base element can be integrally formed with at least one of the cover elements and may further preferred cover bottom regions (e.g. bottom rim portions or edges) of the pouches. The stand-up packaging thus provides a stable supporting region to carry the stand-up packaging, which preferably covers bottom regions of the pouches to protect the same.

The cover elements may be integrally provided with each other to form an outer packaging having any desired layout. Preferred layouts of the outer packaging may be a U-shape, a loop-shape or a box-shape.

A U-shaped outer packaging can be obtained if the first and second cover elements are connected by a bending portion which extends over a lateral region (e.g. upper edge or rim portions) of the pouches.

A loop-shaped outer packaging may be obtained if the first and second cover elements are connected by a bending portion, preferably in an upper region of the outer packaging, as described for the U-shaped layout, and the second and third cover elements are connected to one another by a further bending portion, preferably in a bottom region of the outer packaging which extends over another lateral region (e.g. bottom edge or rim portions) of the pouches. Preferably, the first and third cover element overlap with one another, so that the third cover element is at least partially sandwiched between the (neighboring) pouch (e.g. the at least one pouch or one of the additional pouches) and the first cover element. This sandwiched region of the third cover element may function as a gluing region having the through hole(s). The bottom bending region connecting the second and third cover elements may be provided by or may comprise the base element of the outer packaging.

A box-shaped outer packaging may be obtained similar to the loop-shaped outer packaging but further comprising lateral cover elements, which may extend from one of the cover elements (e.g. the second or third cover elements) and are bent to extend to the opposite cover element (e.g. the other of the second or third cover elements) to which the lateral cover elements are preferably glued.

The invention, however, is not limited to a particular shape, but the outer packaging can have any possible shape as long as it allows preferably for one of its outer cover elements to be glued to the at least one pouch via through holes penetrating at least one of the further elements (e.g. additional pouch(es) or third cover element) being sandwiched by said cover element and said pouch.

The outer packaging and preferably at least one of the cover elements may comprise a cut-out region to expose at least one of the pouches. In other words, this cut-out region may function as an inspection window. In a preferred embodiment, the cut-out region is provided such that all of the contained pouches are visible through said cut-out region. Therefore, the pouches can have different lengths or can be provided in an offset manner, accordingly.

The pouches may be made of any food safe material suitable to carry food products. They may be made of plastics. They are preferably at least partially and more preferred circumferentially sealed by the mentioned sealing region to thus (hermetically) seal the carried food products. In a preferred embodiment, the pouches are made of a deformable or flexible material. They can also be made of a transparent material so that the content can be easily inspected by a user. The outer packaging can be made of any material used for outer packagings for food products. In a most preferred embodiment, the outer packaging is made of cardboard or plastics.

Further, features, advantages and objects of the present invention would come apparent for the skilled person when reading the following detailed description of embodiments of the present invention, when taking in conjunction with the Figures of the enclosed drawings.

BRIEF DESCRIPTION OF THE DRAWINGS

FIG. 6 shows three steps of manufacturing a stand-up packaging according to another embodiment of the present invention having an outer packaging according to FIG. 5.

Figures 1A, 2A, 3A:
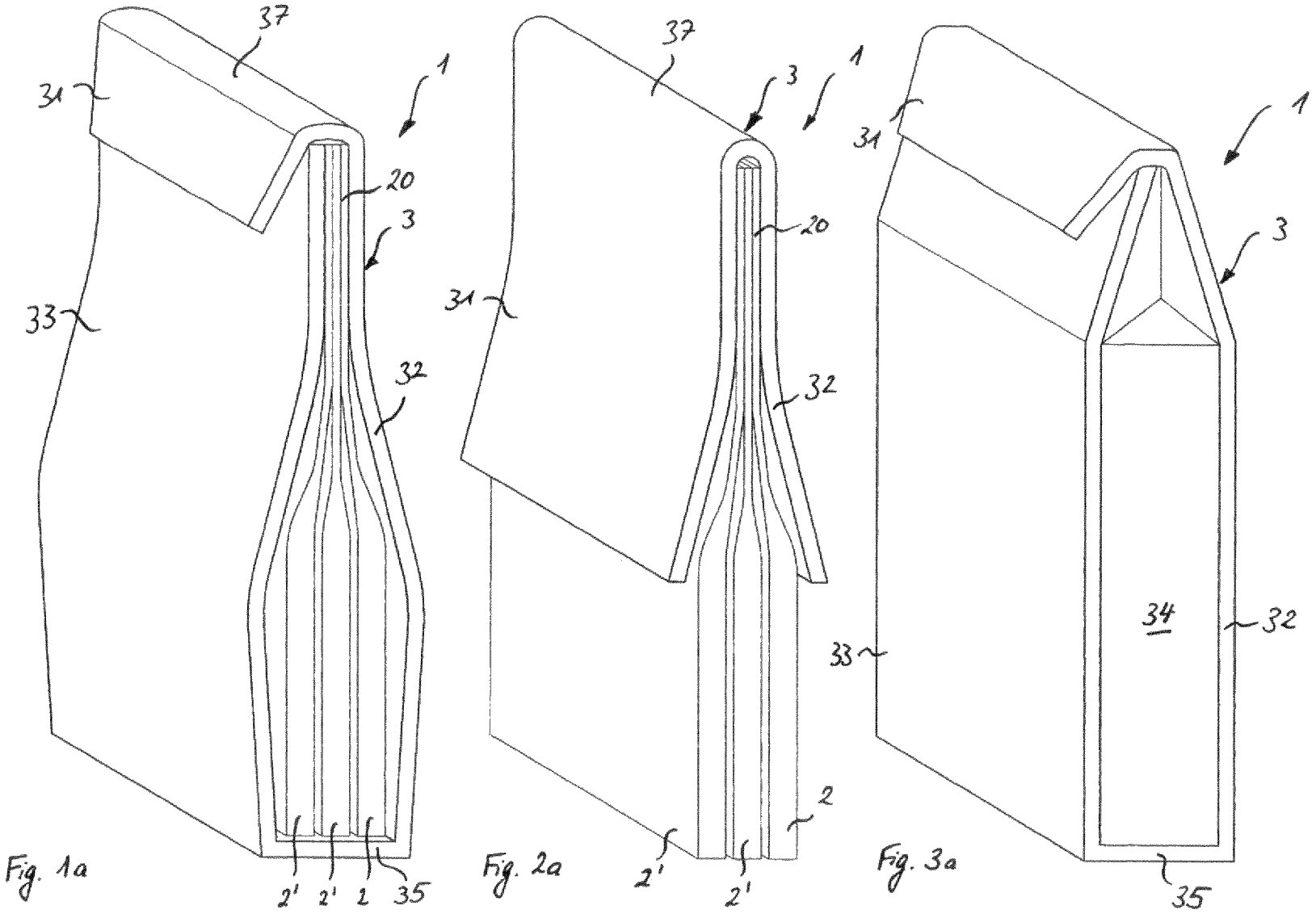
FIG. 1 shows perspective views of two embodiments of a stand-up packaging according to the present invention with a loop-shaped outer packaging and without (FIG. 1*a*) and with a cut-out region (FIG. 1*b*)
FIG. 2 shows perspective views of two further embodiments of a stand-up packaging according to the present invention with a U-shaped outer packaging and with similar (FIG. 2*a*) or different pouches (FIG. 2*b*)
FIG. 3 shows perspective views of two further embodiments of a stand-up packaging according to the present invention with a box-shaped outer packaging and without (FIG. 3*a*) or with a cut-out region (FIG. 3*b*)

In the figures there are shown different embodiments of a stand-up packaging 1 for food products according to the present invention. Food products can be any consumable products in any given state like a fluid, flowable, pasty, jellylike, powdered or solid state.

The stand-up packaging 1 comprises at least one or more pouches 2 for carrying a food product. These pouches 2 can, for instance, be made of a food safe material, preferably plastics. They can have any desired flexibility and tear strength commonly provided for such pouches 2. The pouches 2 are preferably made of a transparent material so that the user can inspect the contents thereof. The pouches 2 may have a sealing region 20. The sealing region 20 may circumferentially surround the pouch 2 to form a pocket 21 to preferably sealingly carry the food product.

The stand-up packaging 1 further comprises an outer packaging 3 having two cover 35 elements 31, 32 (here a first cover element 31 and a second cover element 32) at least partially sandwiching the pouch 2. The outer packaging 3 can be made of any material commonly used for outer packagings, like cardboard or plastics. The outer packaging 3 may carry an imprint to provide information about the stand-up packaging 1 and its content.

The stand-up packaging 1 further comprises at least one or a plurality of further elements. The further element may comprise a third cover element 33 of the outer packaging 3 and/or at least one additional pouch 2' for carrying food products. The additional pouches 2' are preferably similar or generally identical to the at least one pouch 2 described herein above, so that—for the sake of convenience—it is referred to the description of the at least one pouch 2 which also applies for the additional pouches 2'. The further elements 33, 2' are at least partially sandwiched between the pouch 2 and one of the two cover elements (here the first cover element 31).

With respect to FIGS. 1 to 3, 5 and 6, the cover elements 31, 32, 33 can be integrally provided with each other to form the outer packaging 3. With respect to FIG. 2, the two cover elements 31, 32 are integrally provided with each other to form a U-shaped outer packaging 3.

FIGS. 1, 4 and 6 show embodiments in which the three mentioned cover elements 31, 32, 33 are preferably integrally provided with each other to form a loop-shaped outer packaging 3. By overlap of the first cover element 31 and the third cover element 33, the overlapping regions can be secured to each other to provide a closed loop-shaped outer packaging 3 securely surrounding the pouches 2, 2'.

The embodiment of FIG. 3 shows a further layout of the outer packaging 3 having a box-shape. This can, for instance, be obtained by the outer packaging 3 having the three mentioned cover elements 31, 32, 33 and further having lateral cover elements 34 to at least partially cover the lateral sides of the stand-up packaging 1 to thus provide a stable stand-up packaging 1 securely housing the pouches 2, 2'. Preferably, these cover elements 31 to 34 are all integrally formed.

In a preferred embodiment, the outer packaging 3 further comprises a flat base element 35 for supporting or even carrying the stand-up packaging 1. This base element 35 may also be integrally formed with at least one and preferably all of the cover elements (here with all of the other cover elements 31 to 34). As can be clearly seen in FIGS. 1 and 3, the base element 35 preferably covers bottom regions of the pouches 2, 2'.

To easily manufacture the stand-up packaging 1, the cover elements 31 to 35 can be connected by bending regions 37 for facilitating folding of the outer packaging 3 into its final shape to obtain the stand-up packaging 1.

In a preferred embodiment, the bending region 37 connecting the base element 35 with the neighbouring cover elements 32, 33 may comprise contoured cut-out regions 38 which are outwardly exposed in the folded state of the outer packaging 3 constituting supporting feet 39 of the stand-up packaging 1 (see FIG. 6).

Figures 4A, 4B, 4C:
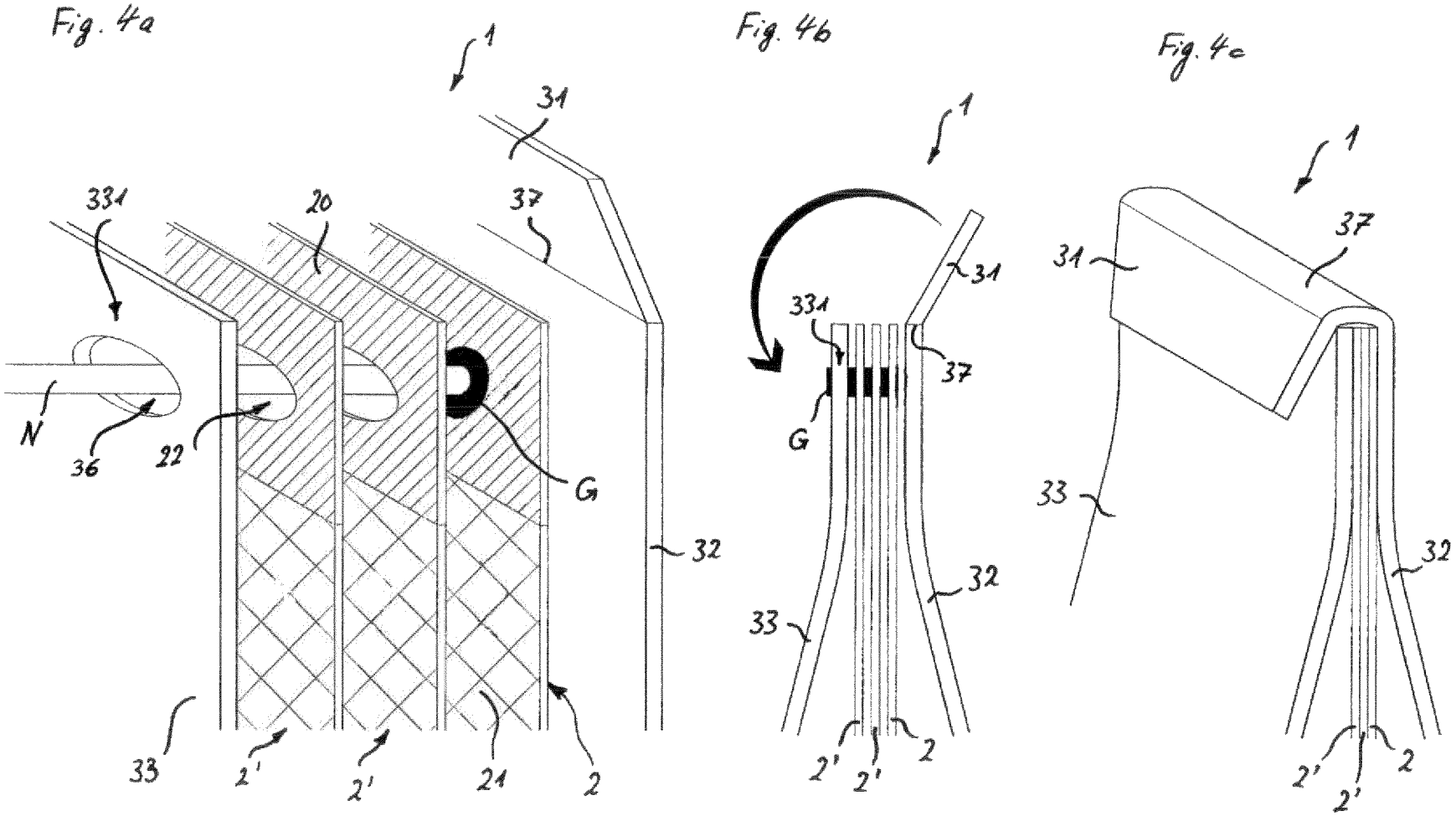
FIG. 4 shows three steps of manufacturing a stand-up packaging according to FIG. 1*a*.

As can be clearly seen in FIG. 4*a*, the further element(s) (i.e. the third cover element 33 and/or additional pouches 2, 2') is/are penetrated by through hole(s) 22, 36, respectively. The through hole 22, 36 can have any shape, e.g. a rounded or polygonal shape. In the shown embodiment of FIGS. 4, 6 and 7, the through hole 22, 36 has an oval shape. However, the shape can also be circular or can be square or of any other shape.

As can be derived from FIG. 4*b*, the one cover element (i.e. the first cover element 31) and the at least one pouch 2 are glued (G) to each other by glue G via the through hole(s) 22, 36 of the further element(s) 33, 2'. The glue G thus forms kind of bolt or plug to allow the outer packaging 3 to be connected with the at least one pouch 2 and—together—carry the additional pouch(es) 2'.

As can be clearly seen in FIG. 4*a*, it is preferably the sealing region 20 of the additional pouches 2' which is penetrated with the through hole(s) 22, 36. Hence, the food product will not be affected by fixing of the additional pouches 2' to the outer packaging 3 and in particular by the glue G used therefore.

The one cover element 31 is glued to the at least one pouch via at least one and preferably via each of the through holes 22, 36 of the further elements (i.e. third cover element 33 and/or additional pouches 2') as can be seen, for instance, in FIG. 4. It is also possible that the one cover element 31 is glued G to at least one of the further elements 33, 2'—and particularly the additional pouches 2'—via at least one of the through holes 22, 36. This allows a flexible attachment of the further elements 33, 2' with respect to each other, the at least one pouch 2 and the outer packaging 3.

The through hole(s) 22, 36 of at least two and preferably of all of the further elements 33, 2' can be aligned to each other. This applies for the through holes 22 of the additional pouches 2 and the through hole(s) 36 of the third cover element 33 with respect to each other. In the shown embodiments and particularly with respect to FIGS. 4*a* and 4*b*, all of the through holes 22, 36 are aligned to each other. The one cover element 31 is then glued to the at least one pouch 2 via each of the through holes 22, 36 at once. However, it is also possible that the through holes 22, 36 or the respective elements carrying the through holes 22, 36 (i.e. the additional pouches 2' and/or the third cover element 33) are offset with respect to one another. If so, at least one of the additional pouches 2' is provided with its through hole 22, 36 such that the one cover element 31 is directly glued to the at least one pouch 2 via this through hole 22, 36. In a preferred embodiment, even with an offset layout, the through holes 22, 36 are provided such that the one cover element 31 can be glued to the at least one pouch 2 via at least some and preferably all of these through holes 22, 36. However, it might also be possible that some of the through holes 22, 36 are provided such that the one cover element 31 is glued via said through hole(s) 22, 36 to one of the further elements 33, 2' (e.g. at least one of the additional pouches 2') with which an intermediate further element 33, 2' carrying said offset through hole 22, 36 is sandwiched.

Figures 5, 6A, 6B, 6C:
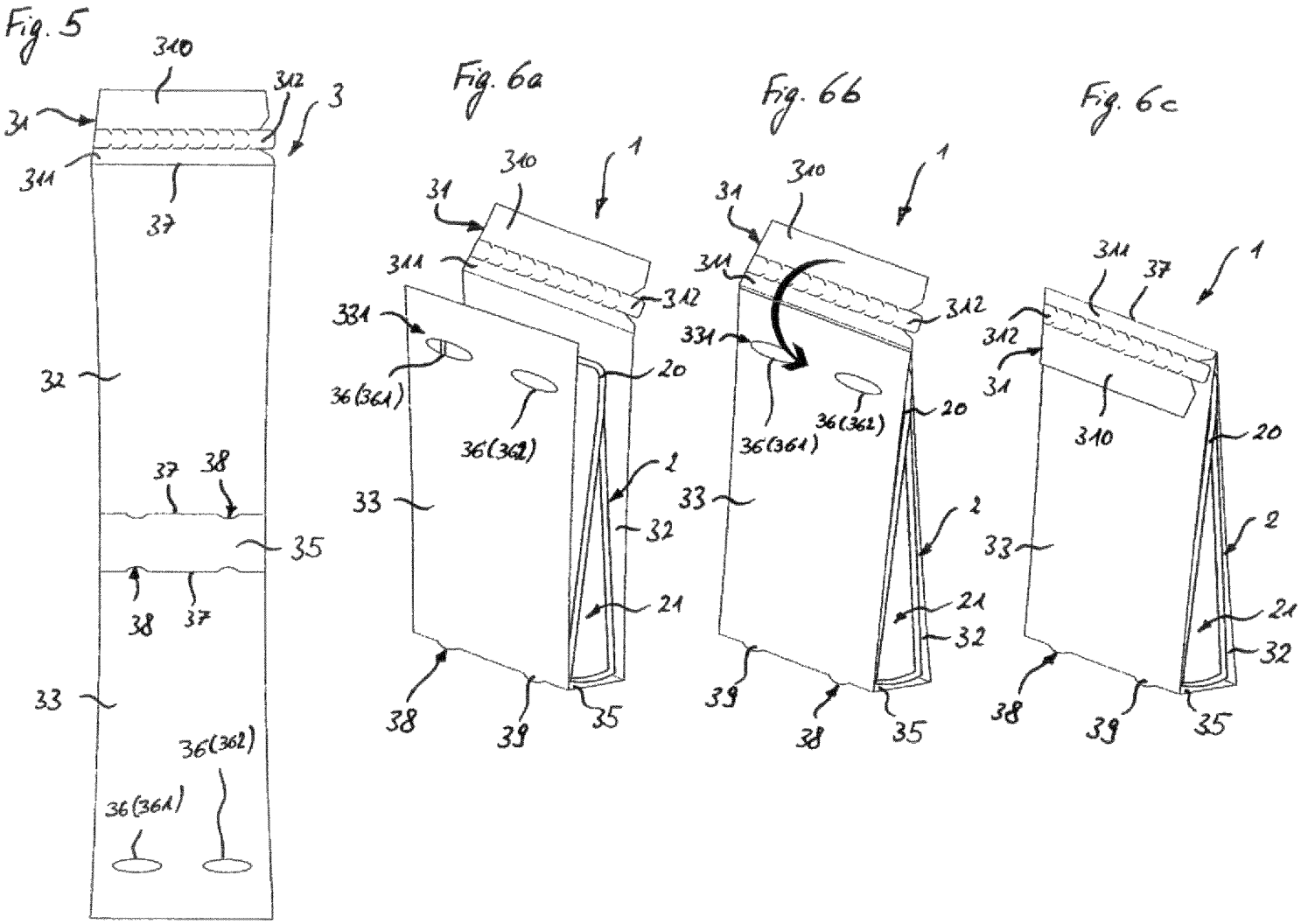
FIG. 5 shows a plan view of an outer packaging of a stand-up packaging according to another embodiment of the present invention in an unfolded state.

As can be gathered from FIGS. 5 to 7, at least one of the through holes 22, 36 and preferably all through holes 22, 36 comprise at least two or even more of distant through holes 361, 362. The distant through holes 361, 362 of at least two through holes 22, 36 and preferably of all of the through holes 22, 36 are aligned to each other, respectively, so that the one cover element 31 is directly glued to the at least one pouch via each of an aligned group of distant through holes 361, 362, respectively. The provision of at least two distant through holes 361, 362 allows for a stable fixation of the pouches 2, 2' to the outer packaging 3 and may reduce the risk of twisting moments acting upon the glued fixation of the one cover element 31 and at least one pouch 2 via the through hole(s) 22, 36 of the further elements 33, 2'.

Figure 7B:
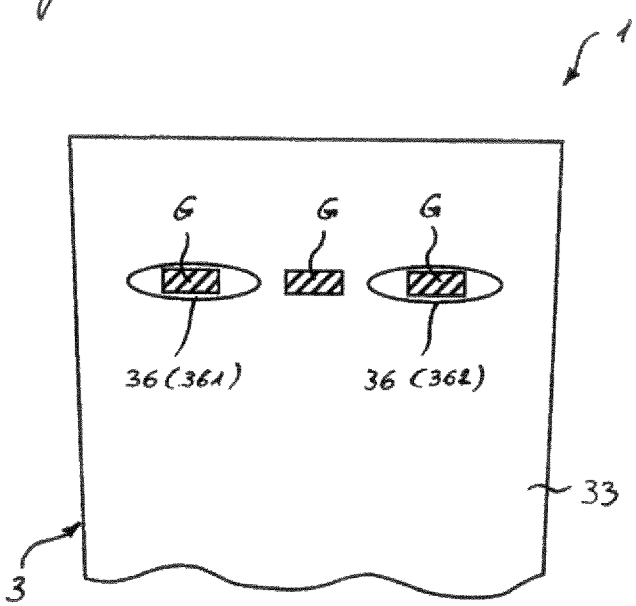
FIG. 7 shows a detail of two embodiments of a stand-up packaging based on FIG. 6 and comprising a line of glue (FIG. 7*a*) or glue dots (FIG. 7*b*).
Figure 7A:
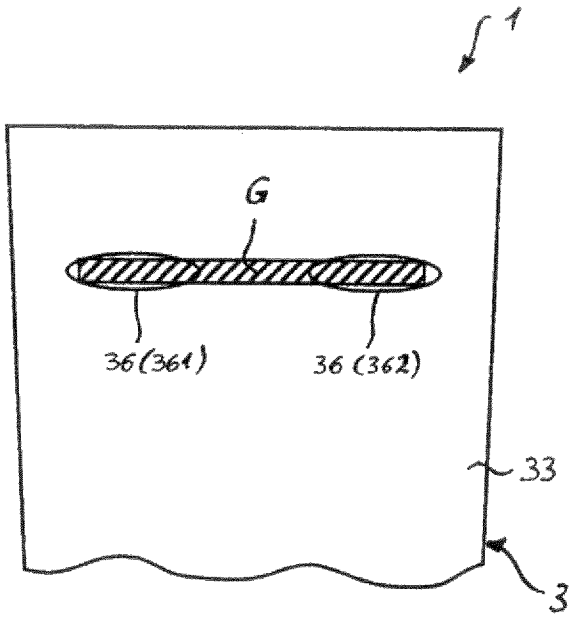

As can be exemplarily seen in FIG. 7, glue G can be provided in different ways. For instance, glue G can be provided as glue dots (FIG. 7*b*) or as a line of glue (FIG. 7*a*). In any case, the glue G at least partially covers the through holes 22, 36. With the provision of glue dots as shown in FIG. 7*b*, a reduced amount of glue G can be provided to allow for a secure fixation and closing of the stand-up packaging 1. The use of a line of glue as shown in FIG. 7*a* allows for a quick and easy application of glue G on the stand-up packaging 1.

As can be seen in the embodiments of FIG. 7, there is provided glue G in and via (i.e. through) the through holes 22, 36. In addition, there can also be provided glue G directly on at least one of the further elements 33, 2' neighboring the one cover element 31 (here on the third cover element 33; alternatively or additionally on the additional pouch(es) 2'). In this regard, at least one of the two cover elements 31, 32—here preferably the first cover element 31—can be directly glued to at least one of the (neighboring) further elements (here to the third cover element 33; alternatively or additionally to the additional pouch(es) 2'). This either directly by flat contact and glue G being provided between these elements as shown in FIG. 7 or via a through hole 22, 36 provided in an intermediate further element (e.g. additional pouch 2' and/or third cover element 33) being sandwiched by the corresponding cover element 31 and the respective further element 33, 2'.

As can be seen in FIGS. 5 and 6, at least one of the cover elements—here the first cover element 31—may comprise different functional regions. In particular, the cover element 31 may comprise a gluing region 310 forming the region being glued to the at least one pouch 2 via the through holes 22, 36. The first cover element 31 may further have a flap region 311, which is divided from the gluing region 310 by a weakened tear-opening region 312. The tear-opening region 312 can be configured in any desired manner to allow separation of the gluing region 310 and the flap region 311. In a preferred embodiment, the tear-opening region 312 is provided such that it is removable from the stand-up packaging 1 in a destructive or non-destructive manner to thus release the flap region 311 to access the pouches 2, 2' in the stand-up packaging 1.

Figures 1B, 2B, 3B:
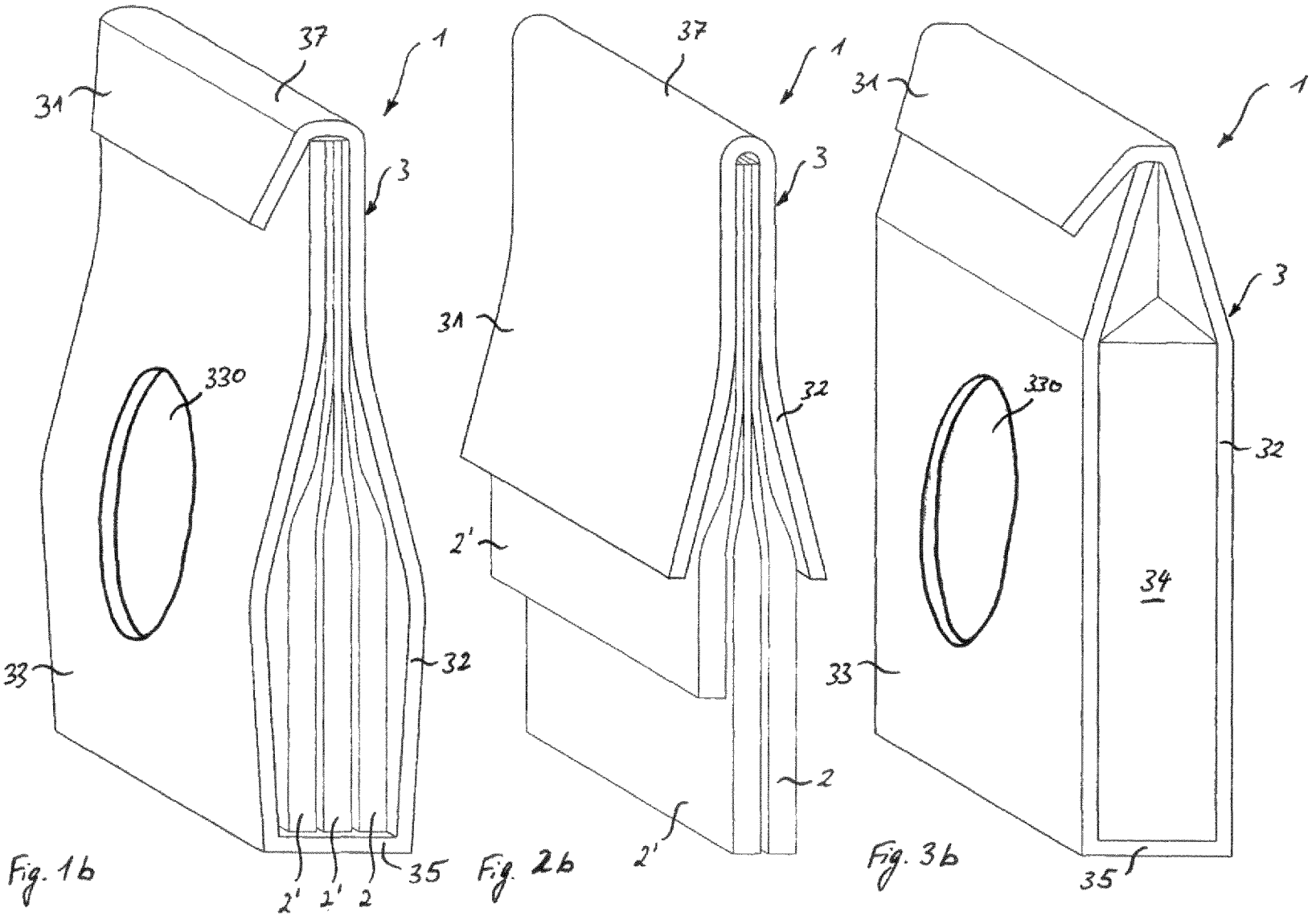

As can be further seen in FIGS. 1*b* and 3*b*, the outer packaging, preferably at least one of the cover elements—here the third cover element 33—, may comprise a cut-out region 330 to expose at least one of the pouches 2, 2'. The cut-out region 330 may thus form an inspection window to allow the user inspection of the content of the corresponding pouches 2, 2'. The cut-out region 330 is here shown as a circular window. However, neither the shape nor the position nor the dimension of the cut-out region 330 is limited by the present invention. Inspection of the pouches 2, 2' may alternatively or additionally be enhanced if the pouches 2, 2' are provided such that they do only partially overlap with one another as can, for instance, be seen in FIG. 2*b*. Here, the partial overlap is obtained by the pouches 2, 2' having different dimension and/or shapes to thus allow at least part of the respective pouches 2, 2' being outwardly exposed. Alternatively or additionally, the pouches 2, 2' may also be offset with respect to one another.

FIG. 6 shows a most preferred embodiment of the present invention. Here, the stand-up packaging 1 for food products comprises a (one) pouch 2 for carrying a food product. Further, the stand-up packaging 1 comprises an outer packaging 3 having a generally loop-shaped layout. Therefore, different cover elements 31, 32, 33, 35 are integrally formed with each other and bend 37 to obtain the loop-shape. The packaging 3 comprises two cover elements 31, 32 at least partially sandwiching the pouch 2. Moreover, the packaging 3 comprises a further element being a third cover element 33 of the packaging 3 which is at least partially sandwiched between the pouch 2 and the first cover element 31. Second cover element 32 and third cover element 33 are connected by a further cover element being a flat base element 35 for supporting/carrying the stand-up packaging 1. First cover element 31 and the third cover element 33 overlap with each other in an overlapping region. In this overlapping region, these cover elements 31, 33 can be connected (e.g. glued) to each other to form a closed loop-shape packaging 3. The third cover element 33 is penetrated by a through hole 36 comprising two distant through holes 361, 362 in the shown embodiment. The first cover element 31 is glued (via glue G in form of glue dots or a line of glue or the like) to the pouch 2 via (i.e. through) the through hole 36. The glue G provided to glue the first cover element 31 directly to the pouch 2 via (i.e. through) said through hole 36 of the third cover element 33 can be provided such that it also covers regions of the third cover element 33 facing the first cover element 31 surrounding or between the through holes 36. The glue G used for connecting the first cover element 31 with the pouch 2 can thus also be used to fix the first cover element 31 to the third cover element 33 thus obtaining the closed loop-shaped packaging 3.

The first cover element 31 can comprise a gluing region 310 forming part of the overlapping region. The gluing region 310 is the region overlapping with the through holes 36 of the third cover element 33 to be directly glued G to the pouch 2 via said through hole 36. The first cover element 31 may then further comprise a flap region 311 being connected to the gluing region 310 by a weakened tear-opening region 312 being removable to thus release the flap region 311 to access the pouch 2. The flap region 311 is therefore connected to the second cover element 32 via a bending region 37 to allow optional opening of the packaging 3 by bending the flap region 311 with respect to the second cover element 32 to thus access the pouch 2.

In a further aspect of the invention relates to a stand-up packaging (1) for food products comprising:

one pouch (2) for carrying a food product, an outer packaging (3) having two cover elements (31, 32) sandwiching the pouch (2), and one further element (33) sandwiched between the pouch (2) and one of the cover elements (31), wherein the further element (33) is penetrated by a through hole (36), and wherein the one cover element (31) is glued (G) to the pouch (2) via the through hole (36).

FIGS. 4 and 6 show examples of manufacturing the stand-up packaging 1 according to the present invention. In a first step, the pouches 2, 2' and the outer packaging 3 (here having the first to third cover elements 31, 32, 33) are positioned with respect to each other. In particular, the through holes 22, 36 of the respective elements (additional pouches 2' and third cover element 33) are provided such that at least via one of the through holes 22, 36 the at least one pouch 2 is accessible/visible. In the shown embodiment, all of the through holes 22, 36 are aligned to one another so that the at least one pouch 2 is accessible/visible through the whole group of aligned through holes 22, 36. In a next step, glue G is provided such that it at least partially covers the through holes 22, 36 and extends through the through holes 22, 36. As such, glue G is applied to the at least one pouch 2. This can be done either by a glue nozzle N, which is inserted through the through holes 22, 36 to be positioned on or close to the at least one pouch 2, where glue G can be applied onto the at least one pouch 2. When retracting the glue nozzle N out of the through holes 22, 36, glue can be further applied to thus provide glue G from the at least one pouch 2 through the through holes 22, 36. In another embodiment, glue G can also be applied as a line of glue G. Therefore, a glue nozzle can be moved in a direction in parallel with a plane of at least one of the cover elements 31, 32, 33 or pouches 2, 2' such that glue G is applied to cover at least one and preferably all of the through holes 22, 36. In a preferred embodiment, also regions surrounding the through holes 22, 36 or therebetween can be applied with glue G either by the defined line of glue (see FIG. 7*a*) or by glue dots (see FIG. 7*b*) or the like. This allows for additional fixation of neighboring elements (here first and third cover elements 31, 33) as described in the following. After having applied the glue G to the stand-up packaging 1, the one cover element—here the first cover element 31—is positioned or moved into its final position to form the completed stand-up packaging 1. In the shown embodiments, the outer packaging 3 is integrally formed so that the outer packaging 3 is "closed" by simply bending the first cover element 31 via a bending region 37 over the upper rim portions of the pouches 2, 2' to be thus positioned opposite to the second cover element 32 and at least one pouch 2. In a preferred embodiment, a gluing region 310 of the first cover element 31 is thus placed in a region where glue G extends from the at least one pouch 2 through the through holes 22, 36 to thus glue the one cover element 31 to the at least one or plurality of pouches 2 via the respective through holes 22, 36.

The present invention is not limited by the embodiments as described hereinabove, as long as being covered by the appended claims. All the features of the embodiments described herein above can be combined in any possible way and can be interchangeably provided. If the singular form for the features like "through hole" or "pouch" or "cover element" is used in the present invention, it also covers its plural form like "through holes" or "pouches" or "cover elements", respectively. The "at least one pouch" means the pouch 2 to which the one cover element 31 is glued to. The "additional pouch" means the pouch 2' being a further element. If not otherwise indicated, "pouch" covers both of these groups of pouches 2, 2'.

The invention claimed is:

1. A stand-up packaging for food products, the stand-up packaging comprising:

at least one pouch for carrying a food product, and an outer packaging comprising a first cover element, a second cover element integral with the first cover element, a base element integral with the second cover element, and a third cover element integral with the base element, wherein the second cover element and the third cover element at least partially sandwich the at least one pouch, wherein a portion of the third cover element is at least partially sandwiched between the at least one pouch and the first cover element, wherein the third cover element is penetrated by a through hole; and wherein the first cover element is glued to the at least one pouch via the through hole.

2. The stand-up packaging according to claim 1, comprising at least one additional pouch for carrying a further food product.

3. The stand-up packaging according to claim 1, comprising an additional pouch penetrated by a further through hole, wherein the through hole penetrating the third cover element and the further through hole of the additional pouch are aligned with each other.

4. The stand-up packaging according to claim 1, wherein the at least one pouch comprises a sealing region.

5. The stand-up packaging according to claim 4, wherein the sealing region circumferentially surrounds the at least one pouch to form a pocket.

6. The stand-up packaging according to claim 1, wherein the through hole comprises at least two or more distant through holes, and wherein the at least two or more distant through holes are aligned to each other, respectively.

7. The stand-up packaging according to claim 1, wherein the through hole has a rounded or polygonal shape.

8. The stand-up packaging according to claim 1, wherein the first cover element is directly glued to at least one of the third cover element or an additional pouch.

9. The stand-up packaging according to claim 1, wherein glue is provided as one of glue dots or a line of glue at least partially covering the through hole.

10. The stand-up packaging according to claim 1, wherein the first cover element has a gluing region and a flap region being divided by a weakened tear-opening region configured to allow separation of the gluing region and the flap region.

11. The stand-up packaging according to claim 1, wherein the base element is configured for supporting the stand-up packaging, wherein the base element is formed with the second cover element and the third cover element and covers a bottom region of the at least one pouch.

12. The stand-up packaging according to claim 1, wherein the outer packaging comprises a cut-out region to expose the at least one pouch.

13. The stand-up packaging according to claim 1, wherein the at least one pouch is made of a food safe material.

14. The stand-up packaging according to claim 6, wherein the at least two or more distant through holes and at least two or more distant further through holes of an additional pouch are aligned to each other, respectively.

* * * * *